United States Patent [19]

Hannah et al.

[11] Patent Number: 4,619,486

[45] Date of Patent: Oct. 28, 1986

[54] SPINE ASSEMBLY

[75] Inventors: Bruce R. Hannah, Cold Spring, N.Y.; David D. McClanahan, Landsdale; Lee Denny, Quakertown, both of Pa.

[73] Assignee: Knoll International, Inc., New York, N.Y.

[21] Appl. No.: 618,492

[22] Filed: Jun. 8, 1984

[51] Int. Cl.[4] ..... A47B 77/08

[52] U.S. Cl. ..... 312/195; 312/196; 312/198

[58] Field of Search ..... 312/194–196, 312/198, 257 SM, 223

[56] References Cited

U.S. PATENT DOCUMENTS

| | | | |
|---|---|---|---|
| 3,635,174 | 1/1972 | Ball et al. | 312/223 |
| 3,883,196 | 5/1975 | Mohr et al. | 312/257 A |
| 3,883,202 | 5/1975 | Konig | 312/223 |
| 4,066,305 | 1/1978 | Gazarek | 312/223 |
| 4,094,256 | 6/1978 | Holper et al. | 312/223 |
| 4,323,291 | 4/1982 | Ball | 312/196 |
| 4,377,724 | 3/1982 | Wilson | 174/48 |

*Primary Examiner*—William E. Lyddane
*Assistant Examiner*—Joseph Falk
*Attorney, Agent, or Firm*—Thomas A. O'Rourke

[57] ABSTRACT

A spine assembly for supporting desk tops and panels and accessories and providing for the passage of utility and communications lines to the desk tops and panels and accessories, as needed. A housing is utilized open at a bottom portion for receiving the utility and communications lines. An internal strut is included within the housing at a top portion of the housing. The internal strut serves as a support for brackets which extend upwardly in turn to support desk tops and panels and accessories as well as a cover assembly. The cover assembly provides an opening through which utility and communications line pass from the interior of the housing to the exterior thereof. In addition, brackets extend through the cover assembly for supporting panels and accessories above the cover assembly. The spine assembly is free-standing, and may be closed off by end panels as an individual item or joined to one or more other spine assemblies to create a system of furniture.

15 Claims, 12 Drawing Figures

SPINE ASSEMBLY

BACKGROUND AND BRIEF DESCRIPTION OF THE INVENTION

This invention relates to office systems, and more particularly to a system of office furniture designed to provide maximum flexibility to the user in terms of mass produced components which may be used to form individual units or connected together to form assemblies of interconnected items.

Most office systems in use today are formed from free-standing panels which extend upwardly a significant distance above the normal desk top height. To these panels are affixed accessory items, such as storage cabinets, brackets for in turn supporting other items, and desk tops. The present invention is directed to what is termed a "spine" assembly which is preferably free-standing and of a height about the same as that of a typical desk top. The spine assembly is the heart of the system, and may be free-standing itself as a completed item of furniture serving as a low-height panel. Its main function, however, is as a support for a desk top, and as a means for containing utility and communications lines to be distributed to the desk tops. Additionally, the spine assembly provides support for panels and other accessory items that may extend thereabove, as desired. Provision is made to join one spine assembly to another, so that the spine assemblies may be linked to form any desired configuration of interconnected spine assemblies and panels and desk tops and accessories, as desired.

The spine assembly advantageously comprises an interior framework which supports side panels and which includes, at its ends, means for attaching finishing end panels or posts to which may be attached one or more frameworks of other spine assemblies, as desired. The interior framework includes a strut which serves as a support for brackets extending upwardly therefrom in turn used to support desk tops and panels and accessories as well as a cover assembly. The cover assembly itself closes off the top of the housing defining the spine assembly, and provides an opening through which utility and communications lines pass from the interior of the housing to the exterior thereof. Additionally, brackets may extend upwardly through the cover assembly for supporting panels and other accessory items above the cover assembly.

The following patents are representative of the prior art:

| U.S. Pat. No. | Applicant(s) | Issue Date |
|---|---|---|
| 3,883,202 | Karl-Heinz Konig<br>Title: DESK HAVING ELECTRICAL SUPPLY LINES WHICH ARE LAID IN THE TABLE | 05/13/75 |
| 4,094,256 | Manfred Holper et al.<br>Title: WORK TABLE HAVING LINES EMBODIED THEREIN | 06/13/78 |
| 4,377,724 | Harold R. Wilson<br>Title: SPACE DIVIDER WALL STRUCTURE WITH MULTIPLE CIRCUIT POWER SYSTEM | 03/22/83 |

The invention will be more completely understood by reference to the following detailed description of a presently preferred embodiment thereof.

DETAILED DESCRIPTION

Figure 1:
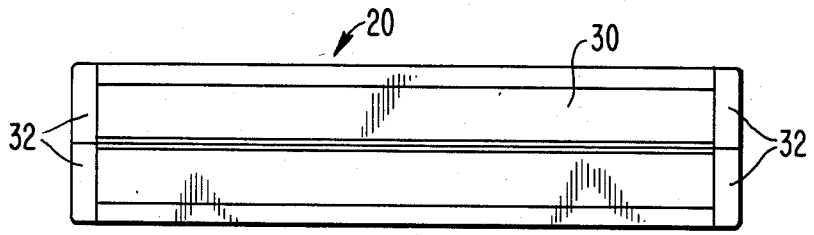
FIG. 1 is a top view of a spine assembly in accordance with the invention.
Figure 2:
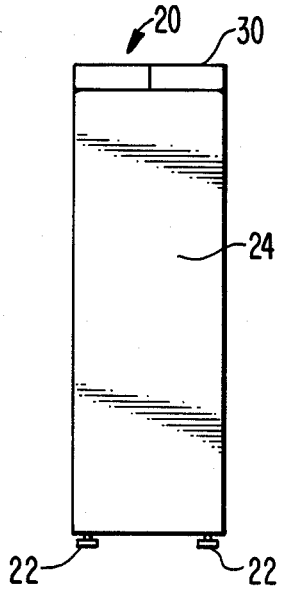
FIGS. 2 and 3 are respectively end and side views of the spine assembly of FIG. 1.
Figure 3:
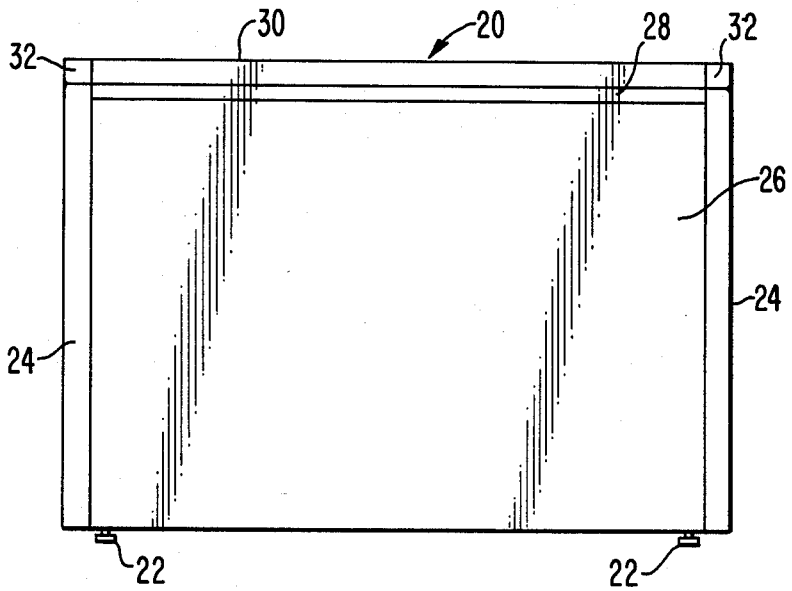

A spine assembly 20 is shown in FIGS. 1 to 3. The spine assembly comprises a housing which is open at its bottom portion in order to receive utility and communications lines. The spine assembly is free-standing, and is supported by levelling glides 22. The spine includes end panels 24, side panels 26 on both sides thereof, including secondary side panels 28, and a cover assembly 30, bounded by end caps 32, all as described in greater detail below.

Figure 4:
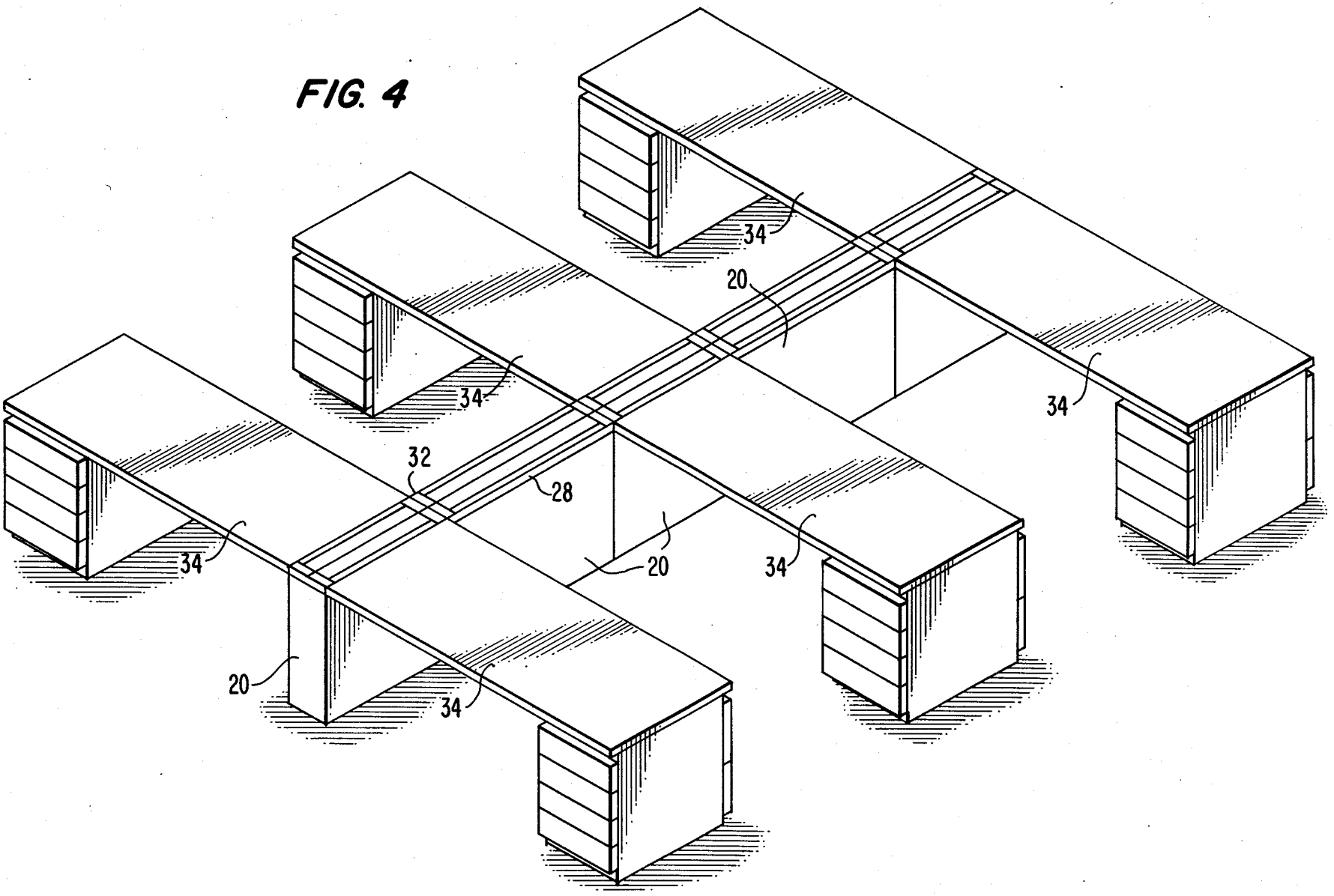
FIG. 4 is a perspective view of a system of interconnected spine assemblies, of the type shown in FIG. 1, supporting desk tops in a series of desk assemblies.

A series of free-standing spines 20 as in FIGS. 1 to 3 may be interconnected in a line, as shown in FIG. 4, and used to support a series of desk tops 34, as shown. Other configurations are possible, as will be explained in more detail below.

Figure 6:
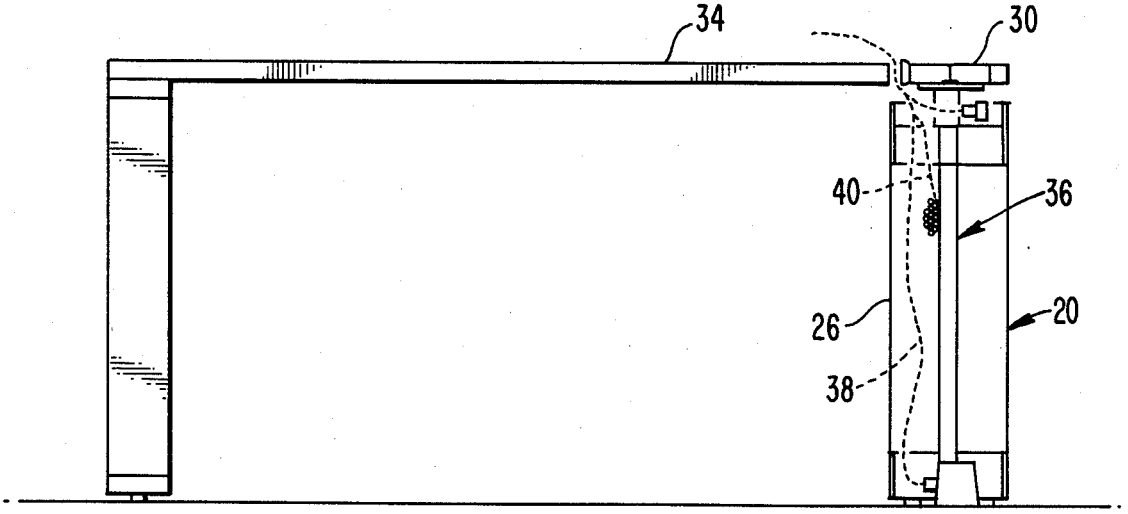
FIG. 6 is a schematic representation of the assembly of FIG. 5, showing the passage of utility and communications lines to the desk top.
Figure 5:
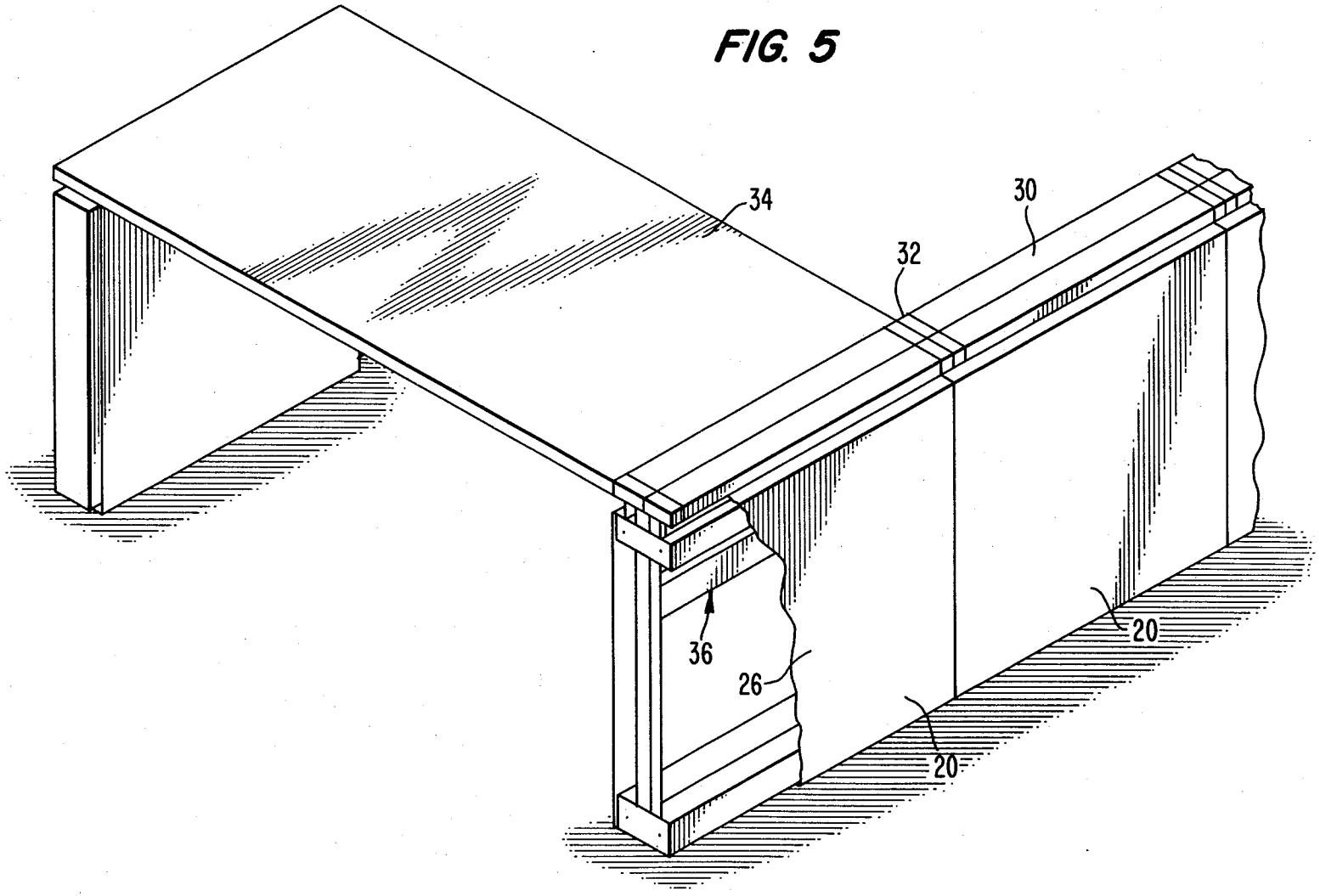
FIG. 5 is a perspective view of a series of interconnected spine assemblies, with one broken away partly to show the interior details thereof, and with one of the spine assemblies used to support a top of a desk.

FIG. 5 is similar to FIG. 4. One of the spines 20 is shown partially broken away to expose the interior details of that assembly. As shown, it is formed from a framework 36, supporting the side panels 26 and hollow in its interior to provide a housing for the passage of utility and communications lines. FIG. 6 schematically shows the spine assembly 20 and illustrates the passage of utility line 38 and communications line 40 from within the housing and outwardly thereof past the cover assembly 30 to the area of desk top 34. It should be noted that FIG. 6 is schematic and is not intended to illustrate the details of the spine assembly, which are given below in connection with the description of the remaining figures in the application.

Figure 7:
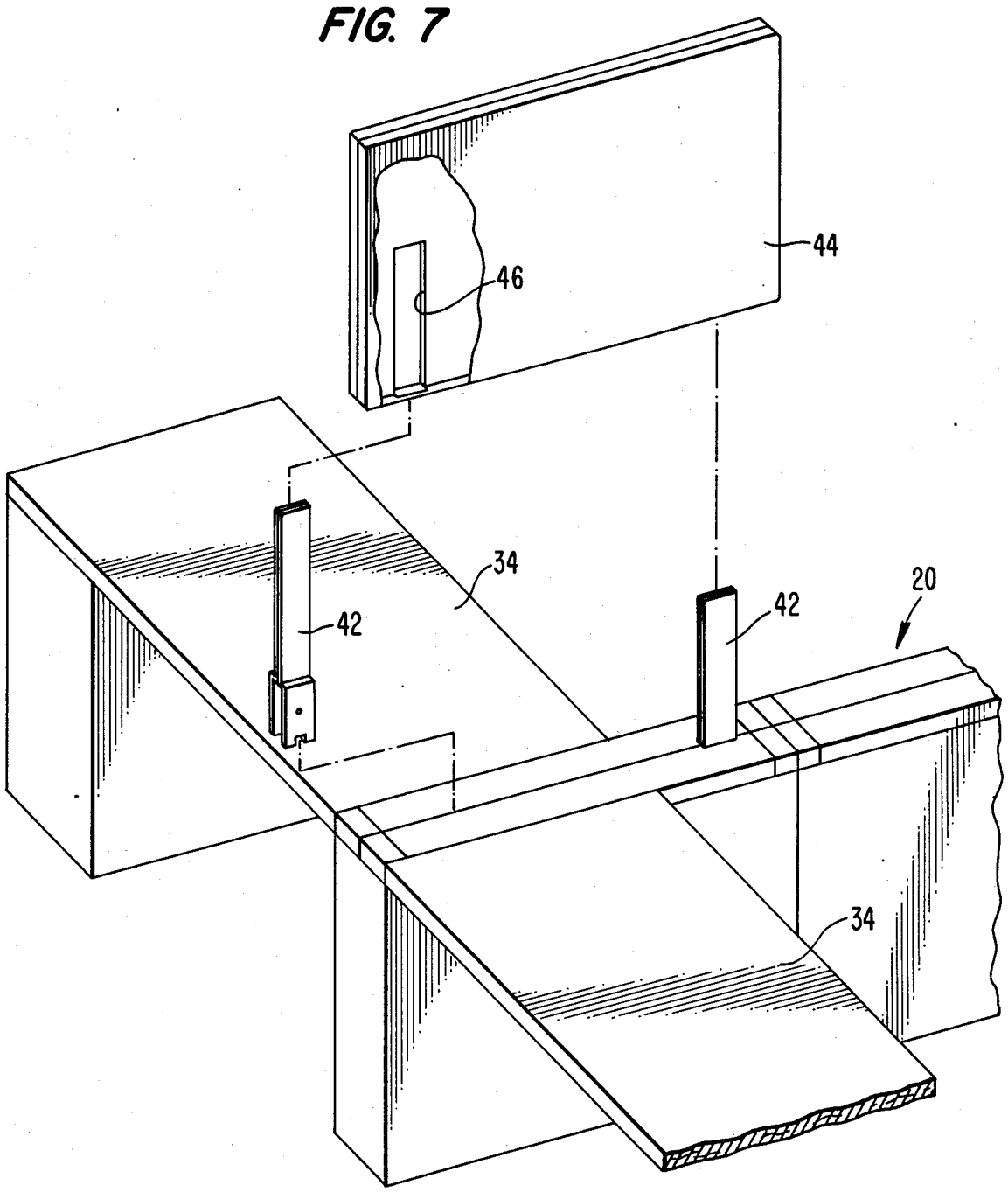
FIG. 7 is a view of a system similar to that of FIG. 4, showing the addition of brackets supported by the spine assembly in turn used to support a panel above the spine assembly.

FIG. 7 shows an arrangement similar to that of FIG. 4, and illustrates the use of brackets 42 which extend upwardly from the spine assembly and used to support a panel 44 above that spine assembly. The brackets 42 are bayonet-type, and extend upwardly within channel 46 inside the panel 44 to support that panel above the spine assembly and above the level of the desk top 34.

Figure 8:
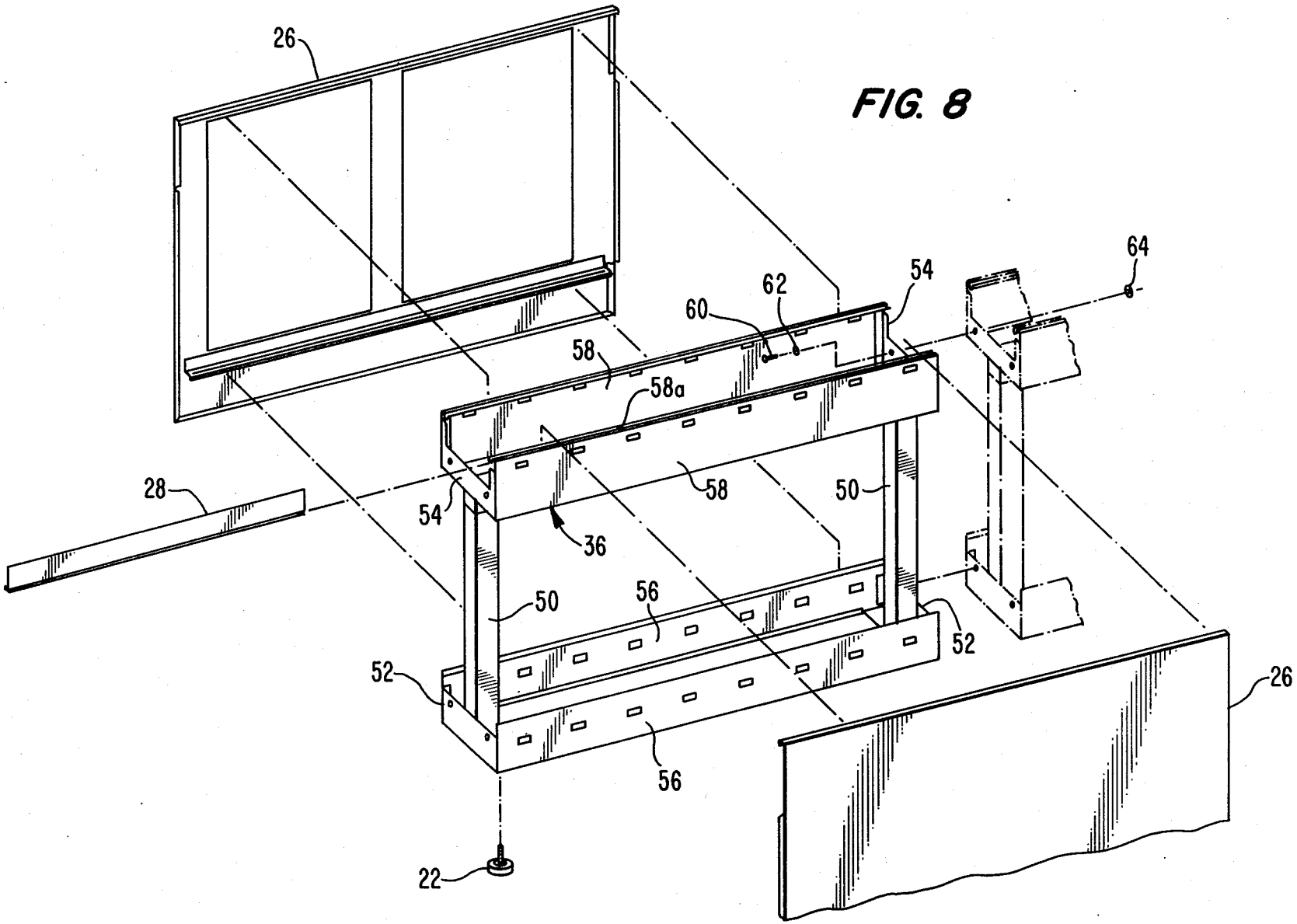
FIG. 8 is an exploded view of a presently preferred form of spine assembly.

FIG. 8 shows some of the details of a spine assembly. The basic framework 36 is defined by upwardly extending struts 50 which in turn support transverse supports 52 at the lower portions thereof and transverse struts 54 at the upper portions thereof. The transverse struts 52 and 54 in turn support side pieces 56 and 58 respectively. The side pieces 56 and 58 on both sides of the basic framework 36 in turn support side panels 26. The secondary side panels 28 are supported, as shown in FIG. 8, by the side pieces 58; they slide in track portions 58*a* of those side pieces. As is apparent from FIG. 8, the upwardly extending struts 50 lie totally within the space between and are spaced from the side panels 26; this spacing permits the unimpeded laying of electrical wiring within the housing and to pass from one housing to another. As shown in FIG. 8, screw 60, lock washer 62, and nut 64 may be used to join together adjacent spine assemblies, in one method of fastening such assemblies together to form a line of such assemblies.

Figure 9:
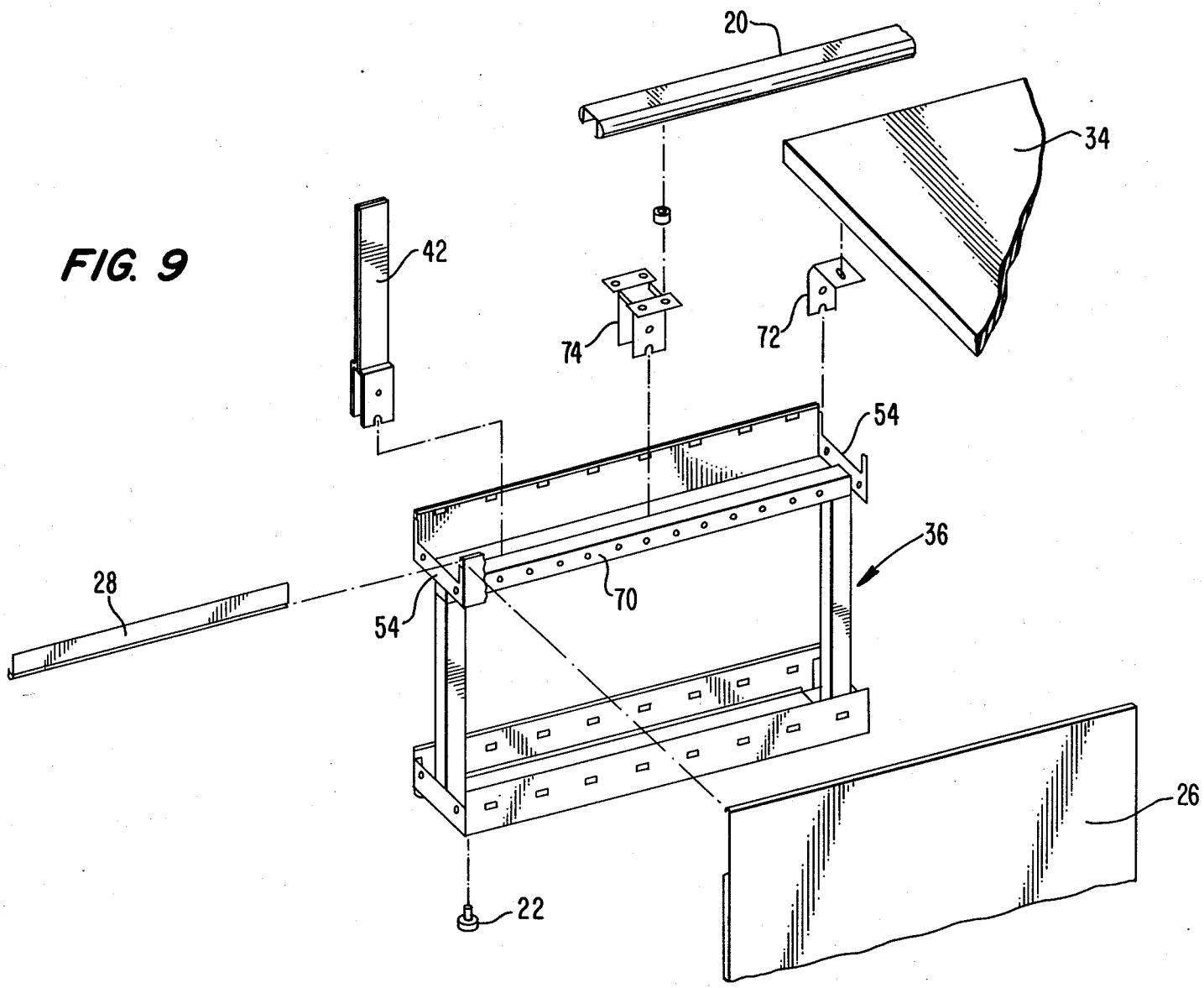
FIG. 9 is another exploded view of the spine assembly of FIG. 8, showing the addition of brackets secured to a central strut comprising a part of the framework of the spine assembly.

Refer to FIG. 9, which shows further details of the basic framework 36 forming the spine assembly. The transverse end pieces 54 support a central strut 70 which is positioned generally at top portion of the spine assembly. That central strut in turn is used as a support for various brackets, such as the bracket 42 previously described that in turn supports panels such as the panel 44 in FIG. 7. Additionally, the central strut 70 supports bracket 72, used to hold desk top 34. Finally, an additional bracket 74 is shown in FIG. 9, supported by the central strut 70, serving as support for the cover assembly 20, part of which is shown in FIG. 9. The details of that cover assembly support are shown in FIG. 10.

Figure 10:
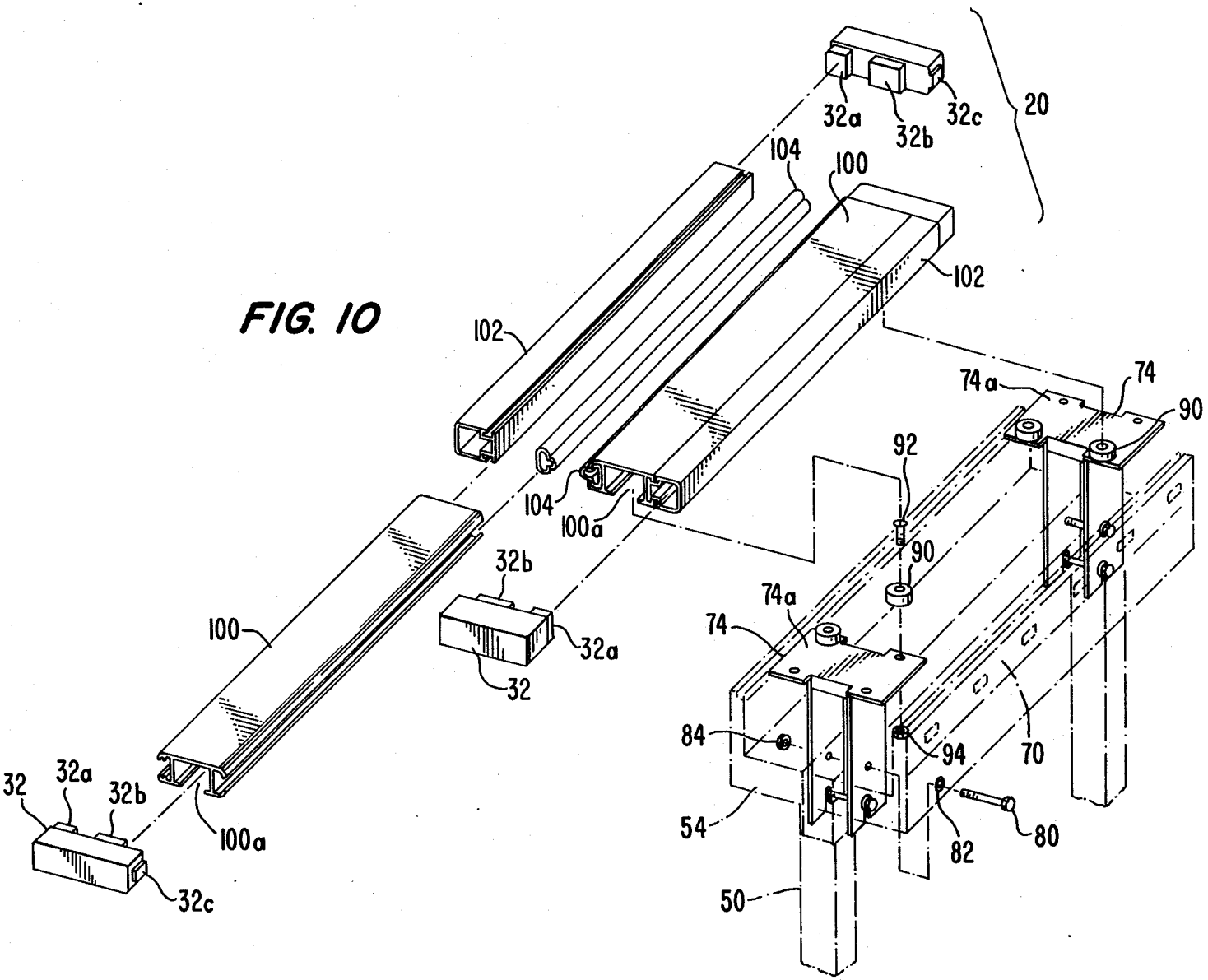
FIG. 10 is an exploded view showing the details of a cover assembly useful with the spine assembly of FIGS. 8 and 9.

Referring to FIG. 10, the brackets 74 are held to the central strut 70 by bolts 80, lock washers 82, and nuts 84. Each bracket 74 includes a horizontal top plate 74*a* that supports a circular plug 90, held in place by screw 92 and nut 94. There are two of such plugs on each plate 74*a*, and these plugs serve as "snap-on" supports for extrusions 100 that form a part of the cover assembly 20. There are two of such extrusions 100, and each includes a channel 100*a* in a lower portion thereof which snaps over the plugs 90 to hold the extrusions in place. Each extrusion 100 includes along an outer periphery thereof an extrusion of plastic material which is flexible and deformable to permit utility and communications lines to pass thereby from within the spine assembly. These flexible extrusions are designated 102 in FIG. 10. Additionally, on the opposite side of the extrusions 100 are extrusions 104 of flexible material, such as vinyl, there being two of the same in a single cover assembly 20 which abut to form a "soft" joint in the middle of the cover assembly extending longitudinally therealong. Brackets such as the bracket 42 in FIG. 9 may extend upwardly through that cover assembly 20, passing between adjacent flexible extrusions 104 by slightly deforming the same.

As shown in FIG. 10, end caps 32 are carried by extrusions 100 and 102, with projections 32*a* and 32*b* extending into and held respectively by extrusions 102 and 100. It will be noted also that the end cap 32 include projections 32*c* on the side thereof which are used to space one end piece 32 from another.

Figure 11:
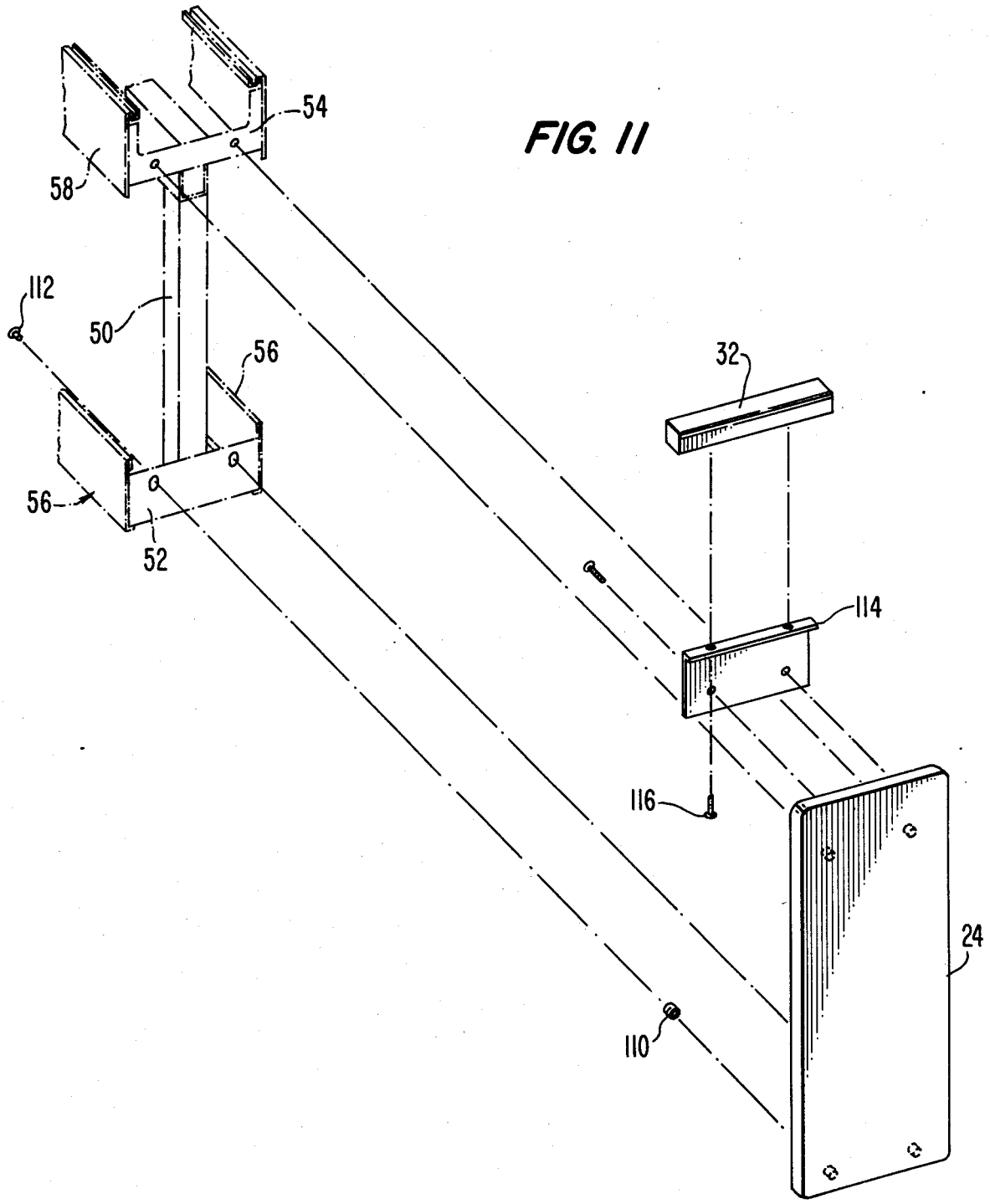
FIG. 11 is an exploded view showing a presently preferred form of end panel for closing off a spine assembly.

FIG. 11 shows one arrangement for finishing off the end of a spine assembly. The end panel 24 is held in place by fasteners 110 and 112. It will be noted that a plate 114 may be positioned between the end panel 24 and transverse cross piece 54 of the spine assembly. Screws 116 may be used, as desired, to attach the end piece 32 to the plate 114.

Figure 12:
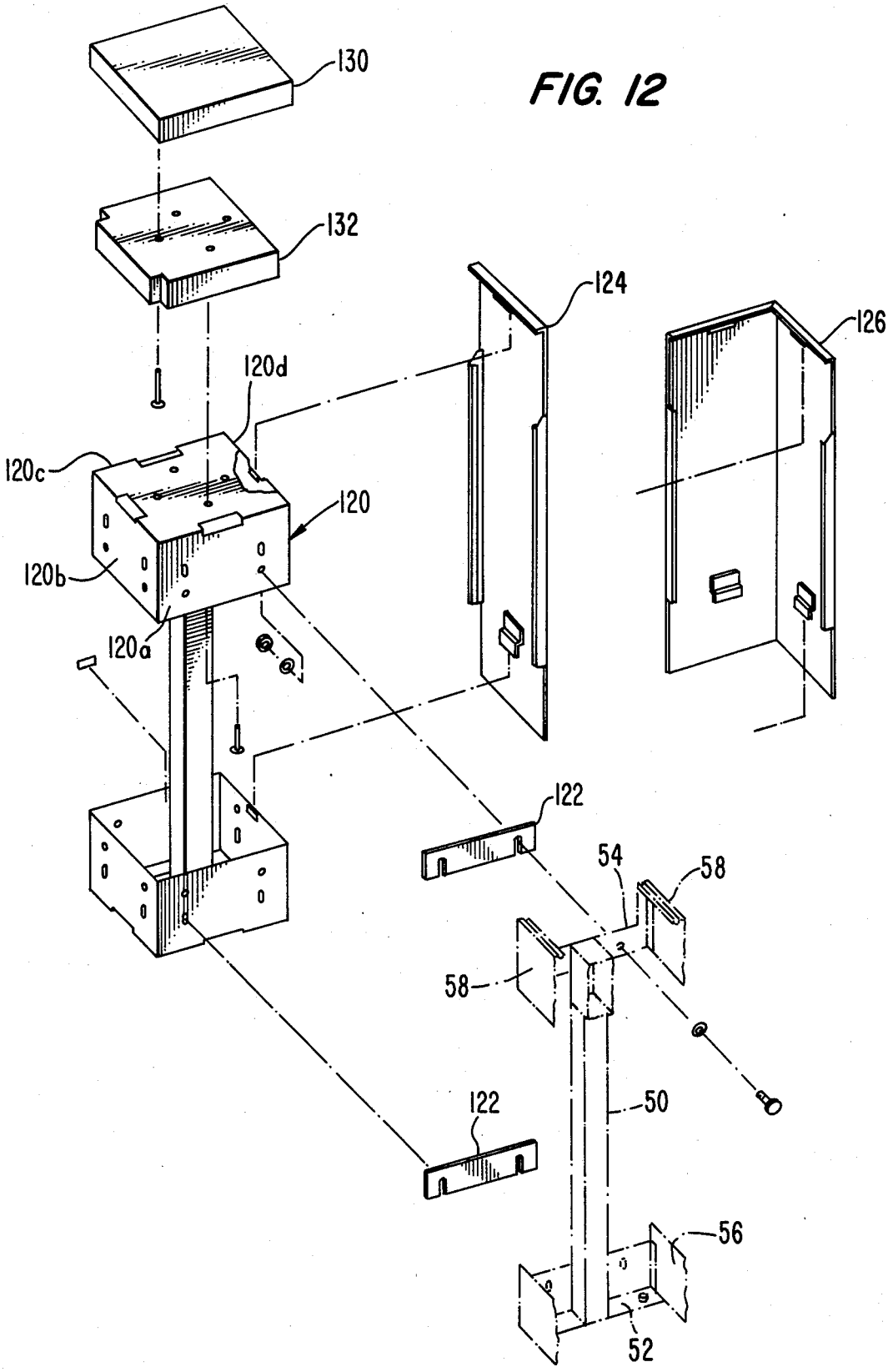
FIG. 12 is an exploded view illustrating a presently preferred form of post used to join one spine assembly to one or more other spine assemblies, and showing representative panels used to finish off the post.

Referring to FIG. 12, a post 120 is shown which may be used to join one spine assembly to another, for example, to form right-angled lines of spine assemblies. The post 120 is attached to the spine assembly by conventional fasteners, such as screws and nuts, as shown, and spacers 122 may be employed. Representative panels 124 and 126 may be used to finish off the post, in the event that a line of spine assemblies is not used. For example, if the post 120 supports three spine assemblies from faces 120*a*, 120*b* and 120*c*, then panel 124, fastened as shown to the post, will be used to finish off the remaining post face 120*d*. In the event that spine assemblies are fastened only to post faces 120*a* and 120*b*, then panel 126 will be attached to the post to finish off the post faces 120*c* and 120*d*. Finally, top cap 130 may be fastened to the top of the post 120 by use of intermediate spacer 132.

SUMMARY

There has been described a spine assembly which is extremely versatile in providing support for an individual desk top or a plurality of desk tops, as well as upwardly extending panels and other accessories, as desired. The spine assembly forms a basic free-standing component, which may be used by itself, or in combination with other of such assemblies to form interconnected groupings of furniture, as desired.

It will be understood that persons skilled in the art may modify the presently preferred embodiment described herein. Accordingly, this invention should be taken to be defined solely by the following claims.

We claim:

1. A spine system assembly comprising a plurality of housings joined end-to-end to create an interconnected network of such housings, each housing comprising a framework defined by vertical structural support members at each end of the housing, side support members joining together said vertical structural support members and providing support for spaced-apart parallel side panels, said vertical structural support members and said side support members lying totally within the space between said side panels and said vertical structural support members being spaced from said side panels to permit the unimpeded laying of electrical wiring within each housing and from one housing to another.

2. A spine assembly as in claim 1, in which said vertical structural support members include at the ends thereof, means for attaching end panels.

3. A spine assembly as in claim 1, in which said vertical structural support members include at the ends thereof, means for attaching one framework to another.

4. A spine assembly as in claim 1, in which said framework includes a strut joining together said vertical structural support members, and an upwardly extending plate secured at a lower end thereof to said strut, said plate having an upper end serving as a support for an accessory above said spine assembly.

5. A spine assembly according to claim 4, in which said housing includes a top cover assembly, and said upwardly extending plate passes through said cover assembly.

6. A spine assembly as in claim 5, in which said cover assembly includes a strip of rigid material bounded by flexible material which may be deformed to permit said upwardly extending plate to pass therethrough.

7. A spine assembly as in claim 1, in which said cover assembly includes a strip of rigid material bounded by flexible material which may be deformed to permit to pass from the interior of said housing to the exterior thereof.

8. A spine assembly as in claim 1, in which said housing includes a top cover assembly, and said cover assembly includes a strip of rigid material bounded along two opposed parallel edges by flexible material which may be deformed, the flexible material along one of said edges permitting the passage therethrough of one or more plates serving as support for an accessory above said spine assembly, and the flexible material along the other of said edges permitting the passage of electrical wiring from the interior of said housing to the exterior thereof.

9. A spine assembly as in claim 1, in which said housing is free-standing.

10. A spine assembly as in claim 1, in which said framework includes a strut joining together said vertical structural support members, and said housing includes a top cover assembly, and said cover assembly is positioned over said strut and is supported by a bracket attached to said strut, and one or more upwardly extending plates secured at a lower end thereof to said strut and at an upper end thereof to an accessory above said spine assembly.

11. A spine assembly as in claim 10, in which said upwardly extending plate extends through said cover assembly.

12. A spine assembly as in claim 10, in which said side panels extend from the bottom portion of said housing to below said cover assembly, and secondary panels supported by said framework for bridging the gap between said side panels and said cover assembly.

13. A spine assembly as in claim 12, in which said side and secondary panels are supported at least in part by said strut.

14. A spine assembly as in claim 1, in which said housing is open at a bottom portion for receiving electrical wiring.

15. A spine assembly as in claim 1 in which said housing is free-standing.

* * * * *